US009803820B2

(12) United States Patent
Hager et al.

(10) Patent No.: US 9,803,820 B2
(45) Date of Patent: Oct. 31, 2017

(54) GENERATING A LIGHT EMISSION PATTERN IN A FAR FIELD

(71) Applicant: OSRAM GmbH, Munich (DE)

(72) Inventors: Juergen Hager, Herbrechtingen (DE); Stephan Schwaiger, Ulm (DE)

(73) Assignee: OSRAM GmbH, Munich (DE)

( * ) Notice: Subject to any disclaimer, the term of this patent is extended or adjusted under 35 U.S.C. 154(b) by 348 days.

(21) Appl. No.: 14/554,087

(22) Filed: Nov. 26, 2014

(65) Prior Publication Data

US 2015/0176792 A1 Jun. 25, 2015

(30) Foreign Application Priority Data

Dec. 19, 2013 (GB) ..... 10 2013 226 639

(51) Int. Cl.
*F21S 8/10* (2006.01)

(52) U.S. Cl.
CPC ..... *F21S 48/1225* (2013.01); *F21S 48/1131* (2013.01); *F21S 48/1145* (2013.01); *F21S 48/1705* (2013.01); *F21S 48/1742* (2013.01); *F21S 48/328* (2013.01)

(58) Field of Classification Search
CPC ..... F21S 48/1225; F21S 48/1131; F21S 48/1145; F21S 48/1705; F21S 48/1742; F21S 48/328
USPC ..... 362/84, 259, 277, 282, 319, 322, 507, 362/510, 512, 538, 539
See application file for complete search history.

(56) References Cited

U.S. PATENT DOCUMENTS

2006/0227087 A1 10/2006 Hajjar et al.
2011/0116253 A1* 5/2011 Sugiyama ..... F21S 10/007 362/84
2012/0039072 A1 2/2012 Lell et al.
2012/0140507 A1 6/2012 Sato et al.
2013/0088850 A1* 4/2013 Kroell ..... G02B 5/09 362/84
2013/0258689 A1* 10/2013 Takahira ..... F21S 48/17 362/465
2013/0271947 A1 10/2013 Finsterbusch et al.
2013/0301237 A1* 11/2013 Finsterbusch ..... G03B 21/204 362/84

(Continued)

FOREIGN PATENT DOCUMENTS

DE 102010062465 A1 6/2012
EP 2359605 B1 8/2011
WO 2011160680 A1 12/2011

OTHER PUBLICATIONS

Office action received for the parallel German application dated Oct. 1, 2014.

*Primary Examiner* — Laura Tso
(74) *Attorney, Agent, or Firm* — Viering, Jentschura & Partner mbB

(57) ABSTRACT

A lighting device for a headlight for generating a light emission pattern in a far field is provided. The lighting device includes at least two phosphor surfaces arranged rotationally movably between different positions, and at least one light source spaced apart from the phosphor surfaces and serving for emitting primary light for illuminating a portion of the phosphor surfaces. An associated predetermined light emission pattern is generatable in respectively exactly one predetermined position of the phosphor surfaces.

20 Claims, 16 Drawing Sheets

(56) References Cited

U.S. PATENT DOCUMENTS

2014/0185272 A1* 7/2014 Kishimoto ..... F21V 29/02
362/84

* cited by examiner

GENERATING A LIGHT EMISSION PATTERN IN A FAR FIELD

CROSS-REFERENCE TO RELATED APPLICATION

This application claims priority to German Patent Application Serial No. 10 2013 226 639.1, which was filed Dec. 19, 2013, and is incorporated herein by reference in its entirety.

TECHNICAL FIELD

Various embodiments relate generally to a lighting device for a headlight for generating a light emission pattern in a far field, including at least one phosphor surface and at least one light source spaced apart from the phosphor surface and serving for emitting primary light for illuminating the phosphor surface, as a result of which an associated light emission pattern is generatable. Various embodiments are applicable, for example, to a vehicle headlight, in particular for an automobile or truck.

BACKGROUND

WO 2011/160680 A1 discloses a light source arrangement having a primary light source and a secondary light source, wherein the primary light source is designed to illuminate the secondary light source, wherein the secondary light source includes a polyhedron having at least one first and one second phosphor surface, wherein the primary light source includes at least one laser or a light emitting diode, and wherein a drive mechanism is fixed to the primary light source or to the secondary light source.

US 2006/0227087 A1 discloses laser display systems which generate at least one scanning laser beam in order to excite one or more fluorescent materials on a screen which emits light in order to form images. The fluorescent materials may include phosphor materials.

EP 2 359 605 B1 discloses an illuminant having at least one semiconductor laser designed to emit primary radiation having a wavelength of between 360 nm and 485 nm inclusive, and including at least one conversion means disposed downstream of the semiconductor laser and designed to convert at least part of the primary radiation into secondary radiation having a higher wavelength different from the primary radiation, wherein the radiation emitted by the illuminant has an optical coherence length which is at most 50 μm, wherein the conversion means has a concentration of color centers or luminous points which is at least 10^7/μm^3, and the color centers or luminous points are distributed statistically in the conversion means, and wherein a focal spot of the conversion means which is irradiated by the primary radiation has an area of at most 0.5 mm^2.

SUMMARY

A lighting device for a headlight for generating a light emission pattern in a far field is provided. The lighting device includes at least two phosphor surfaces arranged rotationally movably between different positions, and at least one light source spaced apart from the phosphor surfaces and serving for emitting primary light for illuminating a portion of the phosphor surfaces. An associated predetermined light emission pattern is generatable in respectively exactly one predetermined position of the phosphor surfaces.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
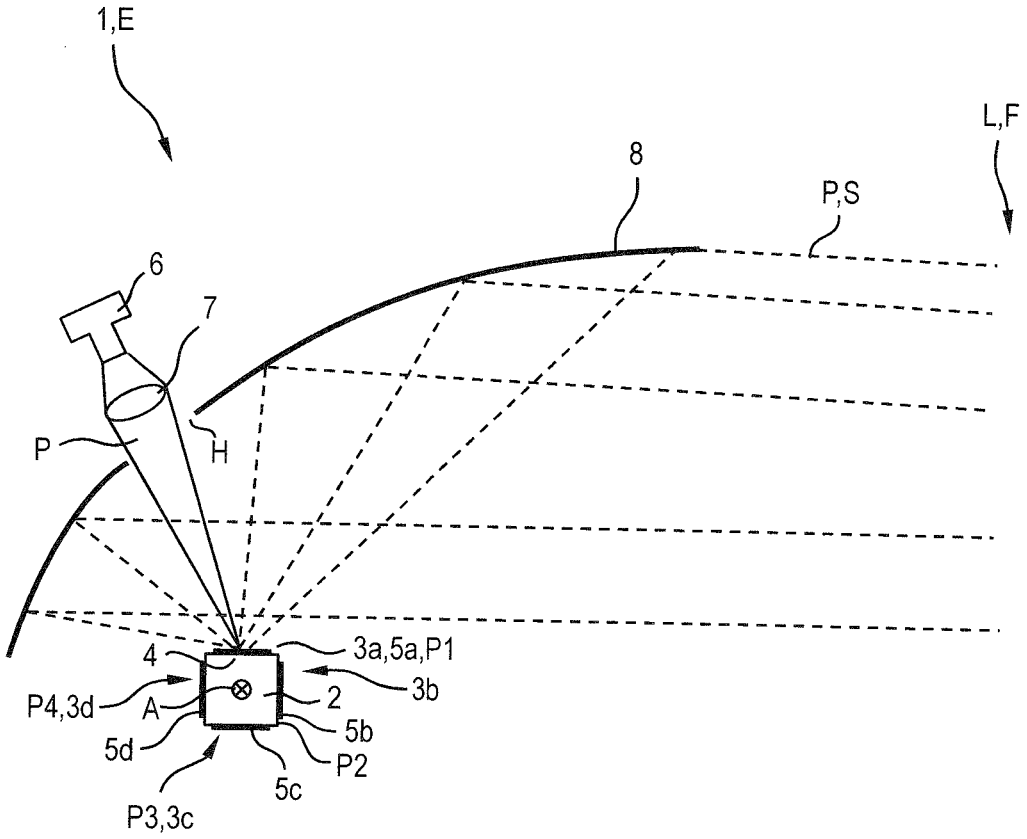
FIGS. 1 to 9 show as a sectional illustration in side view vehicle headlights in accordance with a first to ninth embodiment with rotatable carriers.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

Various embodiments may at least partly overcome the disadvantages of the prior art and may provide an improved possibility for the diverse setting of a light emission pattern by means of a "remote phosphor" device.

Various embodiments provide a lighting device for a headlight, e.g. a vehicle headlight, for generating a light emission pattern in a far field, including at least two phosphor surfaces arranged rotationally movably between different positions, and at least one light source spaced apart from the phosphor surfaces and serving for emitting primary light for illuminating a portion of the phosphor surfaces, wherein an associated predetermined light emission pattern is generatable in respectively exactly one predetermined position of the phosphor surfaces.

The far field may be, for example, a field or space at a distance of at least two meters, e.g. of at least five meters, in front of the headlight.

A phosphor surface includes at least one phosphor or conversion substance (colorant) which converts the primary light incident thereon at least partly into secondary light having a different wavelength, e.g. a higher wavelength. This wavelength conversion is known in principle and need not be explained any further here. By way of example, a phosphor may partly convert incident blue primary light into yellow secondary light, such that blue-yellow or white mixed light having corresponding proportions of primary light and secondary light is emitted overall by the phosphor surface. In principle, however, a full conversion is also possible.

In one development, at each region of the phosphor surface at which phosphor is present, white or whitish light, e.g. mixed light generated by only partial conversion, can be emitted by the phosphor surface. As a result, phosphor surfaces can be excluded, for example, in the case of which the mixed light is generated only downstream of the phosphor surface by superimposition, e.g. by virtue of different-colored radiation generated by the phosphor surface combining behind the phosphor surface. By way of example, phosphor surfaces can thus be excluded which have closely juxtaposed (closely localized) regions having different phosphors (e.g. in the form of stripes or grouped as pixels), wherein the phosphors generate secondary light with respective color proportions of the mixed light. It is therefore possible to exclude, for example, stripes or pixels with phosphors generating primary colors, e.g. the primary colors red, green and/or blue (RGB color space) or cyan, magenta and/or yellow (CMY color space).

However, use of two phosphors having different colors is likewise conceivable in principle, e.g. for a change between a daytime running light or a side light having a white color and a flashing indicator function (e.g. for a direction change indication) having a yellow color.

In one development, the light reflected or backscattered from the phosphor surface is used as useful light for generating the light emission pattern in the far field ("reflective arrangement"). Alternatively or additionally, the light emerging at that side of the phosphor surface which faces away from the incident primary light may be used as useful light for generating a light emission pattern in the far field ("transmitted-light arrangement" or "transmissive arrangement").

The at least one light source is not restricted, in principle, in terms of its type. A light source having a narrow spectral band, e.g. a laser, may be provided for particularly effective wavelength conversion. In one development, at least one light source is a semiconductor light source. In one variant, the at least one semiconductor light source includes at least one light emitting diode. The at least one light emitting diode can itself contain at least one wavelength-converting phosphor (conversion LED). The at least one light emitting diode can be present in the form of at least one individually packaged light emitting diode or in the form of at least one LED chip. A plurality of LED chips can be mounted on a common substrate ("submount"). Instead of or in addition to inorganic light emitting diodes, e.g. on the basis of InGaN or AlInGaP, generally organic LEDs (OLEDs, e.g. polymer OLEDs) can also be used. Alternatively, the at least one semiconductor light source may include or be e.g. at least one diode laser. The at least one semiconductor light source can be equipped with at least one dedicated and/or common optical unit for beam guiding, e.g. at least one Fresnel lens, collimator, and so on.

The light generated by at least one light source may be split into two or more different light beams, e.g. by a beam splitter. Alternatively or additionally, the light from a plurality of light sources may be combined into one light beam.

The construction including the at least one light source spaced apart from the phosphor surface and serving for emitting primary light onto the phosphor surface corresponds to a "remote phosphor" arrangement.

The fact that at least two phosphor surfaces arranged rotationally movably between different positions are present may encompass the fact, for example, that not all of the phosphor surfaces are illuminatable simultaneously, rather at least one phosphor surface is illuminatable in one (rotational) position and is not illuminatable in another (rotational) position.

The fact that an associated predetermined light emission pattern is generatable in respectively exactly one predetermined position of the phosphor surfaces may encompass the fact, for example, that a predetermined light emission pattern is generatable non-sequentially. Non-sequential generation is understood to mean, for example, that the predetermined light emission pattern is not just assembled by temporal integration of a plurality of partial light emission patterns generated one after another, which partial light emission patterns are associated with different positions of the at least one phosphor surface. Sequential generation of a light emission pattern is achieved by the use of a color wheel, for example, in the case of which a plurality of different-colored partial light emission patterns are generated one after another by a change between different phosphor surfaces so rapidly that the human eye integrates them and perceives them only as a sum. In contrast thereto, in the case of the non-sequential generation of a light emission pattern, the position of the at least one phosphor surface may be maintained as long as desired, mainly in particular as long as the associated light emission pattern is to be generated on the roadway. A change between different positions for generating a predetermined light emission pattern can therefor advantageously be avoided.

This lighting device has the advantage that it is possible to switch between different light emission patterns with a comparatively low structural outlay.

It may be suitable for automotive lighting on account of its high luminous flux. In contrast to a linear movement, for example, the rotational movement has the advantage that it can be implemented particularly compactly and mechanically robustly, which may be advantageous e.g. for application in vehicles. In this regard, the rotational movement can be realized in a precise manner by the use of a simple rotary motor, e.g. stepper motor. Moreover, wide rotational movements can thus be achieved without a complex transmission mechanism.

Specific boundary conditions of the vehicle and/or of the driver can be taken into account better by means of changing, for example, the color of the light emission pattern. In this regard, the color can be adapted for example to the presence of fog or rain, but also e.g. to a combination of fog or rain with an old or young driver. Even the individual characteristics of persons who are color blind or partially color blind (e.g. with a red/green deficiency) can then be taken into account. Greater traffic safety can in turn be achieved as a result. Additional convenience for the driver or the occupants can also be produced.

The headlight may be, for example, a vehicle headlight. The vehicle may be an aircraft, a water-bound vehicle or a land-bound vehicle. The land-bound vehicle may be a motor vehicle. The use of the vehicle headlight in a truck or automobile may be provided in various embodiments. By different positions of the at least one phosphor surface, it is possible to generate different automotive light emission patterns, e.g. for generating a low beam, a high beam, a fog light, etc. Alternatively or additionally, it is possible to provide identically shaped light emission patterns having different light colors, e.g. a more bluish daytime running light and a less "blue" position light for use at night.

In one development, at least two phosphor surfaces are arranged in a manner spaced apart from one another, e.g. separated by a gap or an edge or a corner.

In another development, at least two phosphor surfaces are arranged in a manner directly adjoining one another, e.g. are arranged adjacent practically without any gaps, or are embodied as partial regions of a larger (multiple or group) phosphor surface embodied in a continuous fashion.

The shape of a phosphor surface is not restricted and may be at least partly planar or curved. The phosphor surface may be freeform-shaped and have e.g. a plurality of facets.

Disposed upstream of the phosphor surface there may be an optical unit which is concomitantly rotatable or arranged in a stationary fashion with respect thereto, for example for beam shaping and/or spectral filtering of a light beam incident on the phosphor surface and/or for beam shaping and/or spectral filtering of light (including mixed light) emitted by the phosphor surface. The optical unit may include one or a plurality of optical elements, e.g. at least one lens, concentrator, collimator, reflector, diaphragm, filter, etc.

In one development, moreover, downstream of at least one currently illuminatable phosphor surface there is an optical unit for directing the light emitted by the at least one phosphor surface into the far field. This downstream ("secondary") optical unit is, for example, not rotationally movable together with the phosphor surfaces and serves, for example, for beam shaping and/or spectral filtering of the light (including mixed light) emitted by the phosphor surface. The optical unit may include one or a plurality of optical elements, e.g. at least one lens, concentrator, collimator, reflector, diaphragm, filter, etc. During illumination of a plurality of phosphor surfaces, the latter may irradiate identical and/or different regions of the downstream optical unit.

In one development, furthermore, the lighting device includes at least one shell-like reflector disposed downstream of at least one currently illuminatable phosphor surface. The at least one currently illuminatable phosphor surface may be situated in the region of a focal point of the reflector irradiated thereby.

In one configuration, at least two different light emission patterns have a different shape and/or a different color distribution. For the purpose of the different color distribution, at least one phosphor surface may be covered for example inhomogeneously with at least one phosphor, e.g. with an inhomogeneous layer thickness and/or an inhomogeneous phosphor concentration of at least one phosphor, in particular over a large area.

It is also possible for two disjoint (non-overlapping) partial regions to be provided with different phosphors in each case homogeneously.

In another configuration, a light emission pattern is generatable by at least one primary light beam aligned in a stationary fashion (that is to say "statically"). This means, for example, that a light path of at least one primary light beam does not change over time, but rather remains aligned in a stationary or fixed fashion. In this case, the light emission pattern is generated completely e.g. at every point in time. This configuration can be implemented in a particularly simple manner.

In one development which may be provided for this configuration, the at least one primary light beam has a significant cross-sectional size. This affords the advantage that the primary light beam can simultaneously illuminate a large region of the at least one phosphor surface currently illuminatable in the specific situated position.

In another configuration, moreover, a phosphor surface is generatable by a movement of at least one primary light beam (that is to say "dynamically"). This enables—e.g. line by line—scanning illumination of the phosphor surface, in the case of which at least one primary light beam successively illuminates different regions of the at least one phosphor surface. A light emission pattern constructed in a pixel-like manner can in turn be generated as a result. In addition, differently shaped light emission patterns can thus also be generated by means of an identical phosphor surface situated in an identical position.

In a further configuration, a plurality of phosphor surfaces (i.e. at least two thereof) are arranged on at least one rotatable carrier. This affords the advantage that a position of all the phosphor surfaces of the common carrier is variable in a mechanically simple manner, namely by a rotation of the carrier. In various embodiments, a specific angular position of the carrier may correspond to an associated light emission pattern.

In one development, the at least one rotatable carrier includes a plurality of rotatable carriers, e.g. carriers rotatable about an identical rotation axis. The carriers may have the same basic shape. The carriers may be arranged in a series adjacent to one another, e.g. collinearly. In this case, the light emission pattern is generatable e.g. by an addition of the partial light emission patterns of the individual carriers. A change in the light emission pattern can be achieved by means of a rotation of one or a plurality of carriers. This development enables a particularly diverse configuration of the light emission pattern in a simple manner.

In one configuration, moreover, the phosphor surfaces are arranged on a lateral surface of the carrier, which produces a particularly compact and robust design. The phosphor surfaces may be arranged for example in a layered fashion or as a layer or layer system on the lateral surface.

The carrier may have a cylindrical lateral surface or basic shape. The carrier may have for example a circular-cylindrical basic shape, alternatively e.g. an elliptical cross-sectional shape, if appropriate with flattened phosphor surfaces. For particularly simple beam guiding it may be provided for the carrier to have a prismatic basic shape. The associated prisms may be aligned e.g. in a strip-like fashion parallel to the rotation axis, and arranged e.g. rotationally symmetrically about the rotation axis. Adjacent prisms may be configured as different phosphor surfaces. In various embodiments, all the prisms may be configured as different phosphor surfaces. In one development, a prismatic cylinder has a rotationally symmetrical shape in cross section. It may have, in various embodiments, an outer contour that is polygonal (e.g. triangular, rectangular (in particular square), pentagonal, hexagonal, etc.) in cross section.

For effective dissipation of heat from the phosphor, the carrier may include or essentially consist of a highly conductive material, e.g. composed of metal or sapphire. The carrier may be cooled.

In one configuration, furthermore, the phosphor surfaces are arranged in a manner elevated from a carrier, e.g. from the lateral surface thereof. As a result, a setting angle of the primary beams onto the at least one luminous surface can be adjusted particularly flexibly. Moreover, a transmitted-light arrangement is thus made possible in a simple manner. The phosphor surfaces can be elevated perpendicularly or obliquely from the lateral surface.

In principle, however, a transmitted-light arrangement is also possible in the case of the configuration, already described above, wherein the phosphor surfaces are arranged in a layered fashion on a lateral surface of the carrier. For this purpose, the carrier may include or essentially consist of a light-transmissive material, for example.

It is also possible for the phosphor surfaces to be arranged in a matrix-like pattern, wherein e.g. a pixel corresponds to a phosphor surface. By way of example, two or more phosphor surfaces may be arranged on a pivotable carrier (e.g. an MEMS element), wherein, by virtue of a position of the carrier, in each case one of the phosphor surfaces is illuminatable as a pixel. The illuminatable phosphor surface can be changed by a pivoting movement of the carrier. This therefore also corresponds to a matrix-like construction of the carriers. This development may be constructed in a manner similar to a micromirror system (DMD; "Digital Micromirror Device"). Instead of a pivotable carrier, however, a rotatable carrier may also be used, e.g. having a cylindrical basic shape. The carrier may be embodied e.g. as a microroller or the like.

In one configuration, furthermore, the phosphor surfaces are rotatable in a plane, e.g. in a manner similar to a color wheel. However, the generation of the light emission pattern takes place non-sequentially.

In another configuration, moreover, the phosphor surfaces are additionally longitudinally displaceable. This affords the advantage of a particularly diverse selection of phosphor surfaces to be illuminated.

In one configuration, moreover, the light emission pattern is generatable by means of a simultaneous illumination of a plurality of rotationally movable phosphor surfaces. As a result, a light emission pattern can be generated in a particular compact manner. The simultaneous illumination can be implemented for example by means of one or a plurality of primary light beams. The plurality of primary light beams may be generated e.g. by at least one respective light source, alternatively by means of a common light source and subsequent splitting of the primary light beam into a plurality of partial beams.

In one development, a plurality of phosphor surfaces of an identical carrier are illuminatable simultaneously, for example different prisms embodied as phosphor surfaces or different elevated phosphor surfaces.

In one configuration, furthermore, the light emission pattern is generatable by means of a simultaneous illumination of a plurality of individually movable phosphor surfaces. A particularly high diversity of light emission patterns can be generated as a result. One development thereof is the illumination—already discussed above—of the lateral surfaces of cylindrical bodies which are rotatable independently of one another. Another development thereof is an arrangement of a plurality of carriers which are rotationally displaceable and additionally longitudinally displaceable parallel to one another, wherein each carrier has a plurality of phosphor surfaces.

One configuration of the lighting device as a vehicle headlight or part thereof may be provided, wherein the vehicle headlight is designed as an AFS ("Adaptive Front-lighting System") or an ADB (Adaptive Driving Beam) headlight. A simple change that can be implemented in the light emission pattern (e.g. in the light color or color distribution) as a reaction to external influences is possible by changing the position of at least one phosphor surface. Such influences can encompass parameters given by surroundings, such as a weather situation, a state of a roadway, a time of day, a position of the sun, etc., or driver-specific parameters, such as age, fatigue, degree of experience, etc. Such parameters can be detected by a correspondingly configured sensor system of the vehicle, e.g. a camera, a rain sensor, a distance sensor, etc. It is thus also possible, for example, in the context of an AFS or ADB system, to cover specific combinations of parameters in the light distribution automatically (in particular without participation of the driver). That is to say the adaptation of the color not only to the presence of fog, for example, but also to the combination of fog with an old or young driver. The individual characteristics of persons who are color blind or partially color blind (e.g. with a red/green deficiency) can also be taken into account in this way. Greater traffic safety can in turn be achieved as a result. Additional convenience for the driver or the occupants can also be produced.

FIG. 1 shows parts of a lighting device 1 for a vehicle headlight E, e.g. for automobiles, for generating a light emission pattern L in a far field F.

The lighting device 1 includes a cylindrical carrier 2 for phosphor surfaces 3*a* to 3*d*, said carrier being rotatable about its longitudinal axis, which also serves as a rotation axis A. The carrier 2 is embodied as a body of revolution. The carrier 2 has a lateral surface 4 having a rotationally symmetrical, square outer contour. As a result, four prism faces P1 to P4 which run parallel to the rotation axis A and are rotatable about the rotation axis A are formed, which serve as a substrate of the movable phosphor surfaces 3*a* to 3*d*. The prism faces P1 to P4 are covered with a respective phosphor layer 5*a* to 5*d*. The phosphor layers 5*a* to 5*d* may differ in particular in their shape and/or in their phosphor composition. A phosphor composition may be understood to mean, for example, the presence of one or a plurality of specific phosphors, the concentration thereof, the layer thickness thereof and/or the areal distribution thereof or variation thereof. The phosphor layers 5*a* to 5*d* may have, in particular, a phosphor composition that is uniform over their area.

The phosphor surfaces 3*a* to 3*d* cover the prism faces P1 to P4 at least for the most part (i.e. to the extent of more than 50%), e.g. over the whole area.

The carrier 2 can alternatively have e.g. a cross-sectionally curved outer contour, e.g. a circular outer contour or an outer contour having flattened phosphor surfaces, e.g. for simpler fitting of the phosphor layers 5*a* to 5*d*.

The phosphor layers 5*a* to 5*d* may have been sprayed or printed e.g. onto the prism faces P1 to P4. Alternatively, the phosphor layers 5*a* to 5*d* may be applied, e.g. adhesively bonded, as respectively prefabricated laminae (e.g. ceramic laminae) onto the prism faces P1 to P4.

The prism faces P1 to P4 are preferably embodied as specularly reflective or mirroring, e.g. for all wavelengths present, in order that primary radiation passing through the phosphor layers 5*a* to 5*d* can be reflected back into the phosphor layers 5*a* to 5*d* and thus used further. This increases a conversion efficiency.

It is also possible to arrange a dichroic layer between the prism faces P1 to P4 and the phosphor layers 5*a* to 5*d*, which dichroic layer transmits the primary light, but reflects converted secondary light.

The carrier 2 is freely rotatable, such that it is rotatable e.g. also between four different rotational positions which can be realized by rotations by 90° about the rotation axis A. In each of the rotational positions, the phosphor surfaces 3*a* to 3*d* (which are thus movable rotatably with the carrier 2) are situated in a different position, wherein, in the embodiment shown, only one of the phosphor surfaces 3*a* to 3*d* in each case is illuminatable at the same time, namely here the phosphor surface situated in the left position (3*a* in the rotational position shown).

The carrier 2 may consist of metal since the heat that arises in the phosphor as a result of the wavelength conversion can thus be dissipated particularly effectively.

Illumination of the illuminatable phosphor surface 3*a* takes place by a laser 6, which emits blue primary light P, e.g. in the form of one or a plurality of laser diodes. The blue primary light P may, but not necessarily, have a peak wavelength in the wavelength range of 360 nm to 480 nm, e.g. 400 nm to 460 nm.

An optical unit indicated here by a lens 7 is interposed between the laser 6 and the phosphor surface 3*a*, e.g. for the purpose of beam collimation. In one development, the laser 6 and the optical unit 7 possibly present are situated in a common housing and together form one unit. It is alternatively possible to guide the primary light P to the phosphor layer 5*a* via an optical fiber.

Moreover, the primary light P impinging on the phosphor surface 3*a* may be approximately parallelized, instead of being focused as indicated by the lens 7. If a focusing beam path is used, it is also possible, for example, for the phosphor layers 5*a* to 5*d* not to be placed at the focus of the primary light beam, in order to be able to adjust the size of the focal spot more simply.

A secondary optical unit disposed downstream of the phosphor surface 3*a* is shown here on the basis of a shell-like reflector 8. While the laser 6 is situated outside the reflector 8, the phosphor surface 3*a* is arranged in a manner spaced apart therefrom in the reflector 8 in the region of a focal point of the reflector 8. The laser 6 radiates its primary light P onto the phosphor surface 3*a* obliquely here for example, namely through a small hole H in the reflector 8. The reflector 8 may have for example a spherical, paraboloidal or freeform-shaped reflection surface, if appropriate multiply faceted.

The beam path of the primary light P remains unchanged over time, that is to say stationary. Temporally unchanging (static) illumination of the phosphor surfaces 3*a* to 3*d* is achieved as a result.

At the phosphor surface 3*a*, the blue primary light P is at least partly converted into yellow secondary light S, such that blue-yellow or white mixed light P, S is emitted overall by the phosphor surface 3*a*. Depending on the concentration and/or layer thickness of the blue-yellow converting phosphor, the mixed light P, S may have a neutrally white color, a bluish-white color or a yellowish-white color. In various embodiments, the mixed light P, S of each of the phosphor surfaces 3*a* to 3*d* is situated at least regionally within an ECE color space.

The phosphor surface 3*a* is shown here to be larger than the area of the focal spot generated thereon by the primary light P. This is not necessarily required, however. In this regard, it is also possible, for example, for both to be of similar size. Moreover, the focal spot or the cross section of the primary light beam can be larger than the phosphor surface 3*a*. in various embodiments, in that case, the focal spot on the phosphor surface 3*a* can be delimited e.g. by means of a mechanical diaphragm. The latter can be connected to the carrier 2, for example.

The size of the focal spot for typical secondary optical units used (e.g. the reflectors, lenses, etc.) e.g. has an extent of at least 20 micrometers. An extent (e.g. of a diameter) of the focal spot of 50 μm to 500 μm may be provided in various embodiments. If achieving a high luminance is not the foremost aim, a maximum extent of up to 1000 μm may be provided. These values apply, in particular, to illumination or irradiation by means of a laser 6 in the form of a laser diode and with an impinging radiation power of 0.25 W to 4 W. For higher laser powers, it is possible to use these extent values with correspondingly higher achievable luminances. With higher laser powers, however, it is also possible to use larger extents, e.g. a doubling of the area defined by the maximum extent in the case of a doubling of the laser power, etc.

It is possible to excite the phosphor surface 3*a* or the phosphor layer 5*a* by a plurality of lasers 6, e.g. laser diodes. The light thereof can pass through the same hole H in the reflector 8, but alternatively can also pass through different holes to the phosphor surface 3*a* or the phosphor layer 5*a*.

The mixed light P, S is radiated onto the reflector 8 and deflected by the latter into the far field F, e.g. in front of the vehicle. On account of the small hole H, light losses on account of radiation back into the laser 6 are particularly low.

By rotating the carrier 2 by 90° or a multiple thereof, it is optionally possible to rotate each of the phosphor surfaces 3*a*, 3*b*, 3*c* or 3*d* into the primary light beam P. In each of these positions, a different light emission pattern L can thus be generated—even in the case of static illumination. The respective light emission patterns L may differ with regard to their shape, color and/or color distribution. In this case, a specific light emission pattern L is generated non-sequentially. This means that a light emission pattern L is generatable completely with the carrier 2 and thus also the phosphor surfaces 3*a* to 3*d* in exactly one position (corresponding to a specific rotational position). Therefore, for generating a light emission pattern, the carrier 2 need not cause two or more of the phosphor surfaces 3*a*, 3*b*, 3*c* or 3*d* to be illuminated one after another by the primary light P.

The reflector 8 need not necessarily radiate directly into the far field F. It is also possible for the reflector 8 to direct the mixed light P, S into a near field intermediate plane, which can possibly also contain a shutter (not illustrated). The intermediate plane can then be imaged into the far field F e.g. by a refractive optical unit.

It is also possible to change a brightness or laser power of the primary light P with a change in the rotational position of the carrier 2. As a result, the light emission pattern L can be dimmed, e.g. for generating a daytime running light.

If the carrier is rotated from the first position shown by 90° into a second position or rotational position, then the phosphor surface 3*b* instead of the phosphor surface 3*a* is irradiated by the primary light P. A different light emission pattern is generated as a result. The light emission pattern assigned to the phosphor surface 3*b* may differ from the light emission pattern L assigned to the phosphor surface 3*a* with regard to its shape and/or its color. In order to differentiate the shape of their light emission patterns, by way of example, the phosphor layers 5*a* and 5*b* may have a different shape. In order to differentiate the color of their light emission patterns, by way of example, the phosphor layers 5*a* and 5*b* may have a different concentration or layer thickness of the phosphor contained therein. By way of example, a daytime running light with the phosphor surface 3*a* may use bluish-white light, while a flashing indicator function with the phosphor surface 3*b* uses yellow light. For this purpose, by way of example, the phosphor layer 5*a* may contain a smaller proportion of blue-yellow converting phosphor (e.g. on account of a lower concentration and/or layer density).

If the carrier is rotated by a further 90° into a third position or rotational position, the phosphor surface 3*c* is irradiated by the primary light P. Yet another light emission pattern is generated as a result, e.g. for use as a fog light.

If the carrier is rotated again by 90° into a fourth position or rotational position, the phosphor surface 3*d* is irradiated by the primary light P. Yet another light emission pattern is generated as a result, e.g. likewise for use as a daytime running light (if appropriate with dimming of the primary light beam P), but then with an altered color in comparison with the light emission pattern on the basis of phosphor surface 3*a*.

Figure 2:
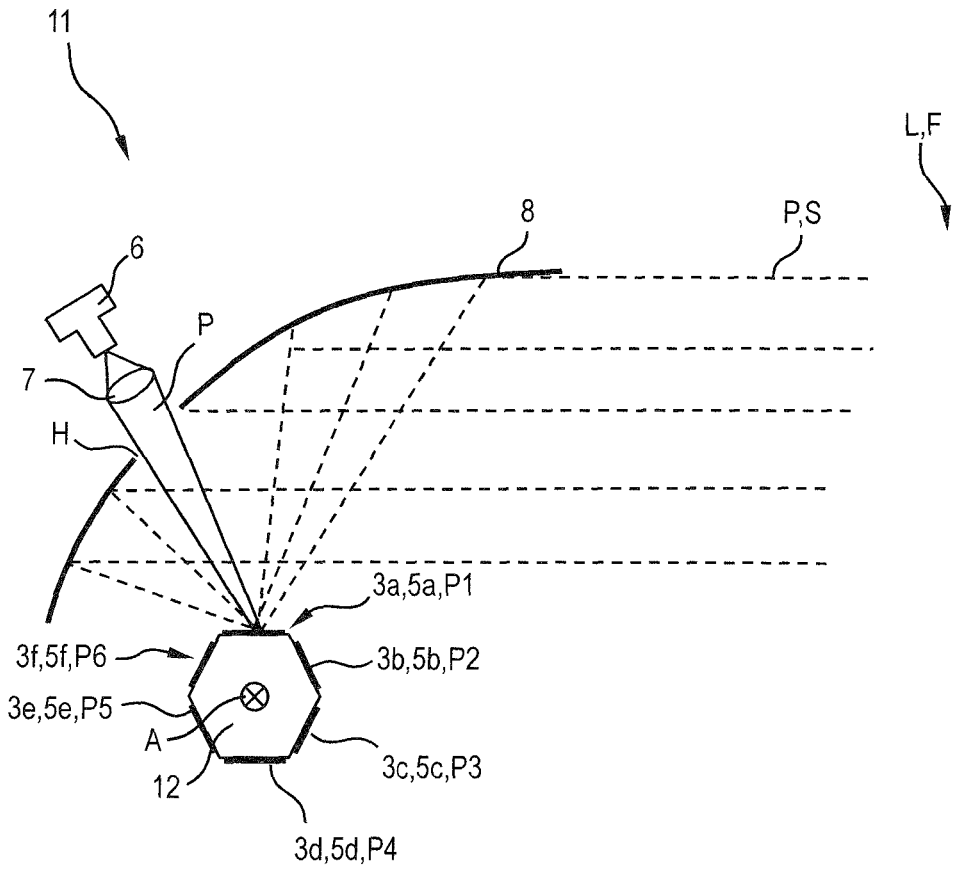

FIG. 2 shows a lighting device 11 e.g. for a vehicle headlight E constructed in a manner similar to the lighting device 1, except that the rotatable carrier 12 now has a cross-sectionally hexagonal outer contour having six prism faces P1 to P6. The prism faces P1 to P6 are covered with respective phosphor layers 5*a* to 5*f*, whereby the phosphor surfaces 3*a* to 3*f* are formed. The phosphor surfaces 3*a* to 3*d* correspond to the phosphor surfaces 3*a* to 3*d* of the lighting device 1.

The phosphor surfaces 3*e* and 3*f* now additionally present here may generate for example respective light emission patterns in a different color (e.g. in a different whitish hue), for example in order to be able to react to parameters in the surroundings of the vehicle such as rain and/or a state of the driver such as the latter's fatigue, e.g. in the context of an AFS or ADB. For switching between different positions of the carrier 12, a rotation by 60° or a multiple thereof is now carried out.

Figure 3:
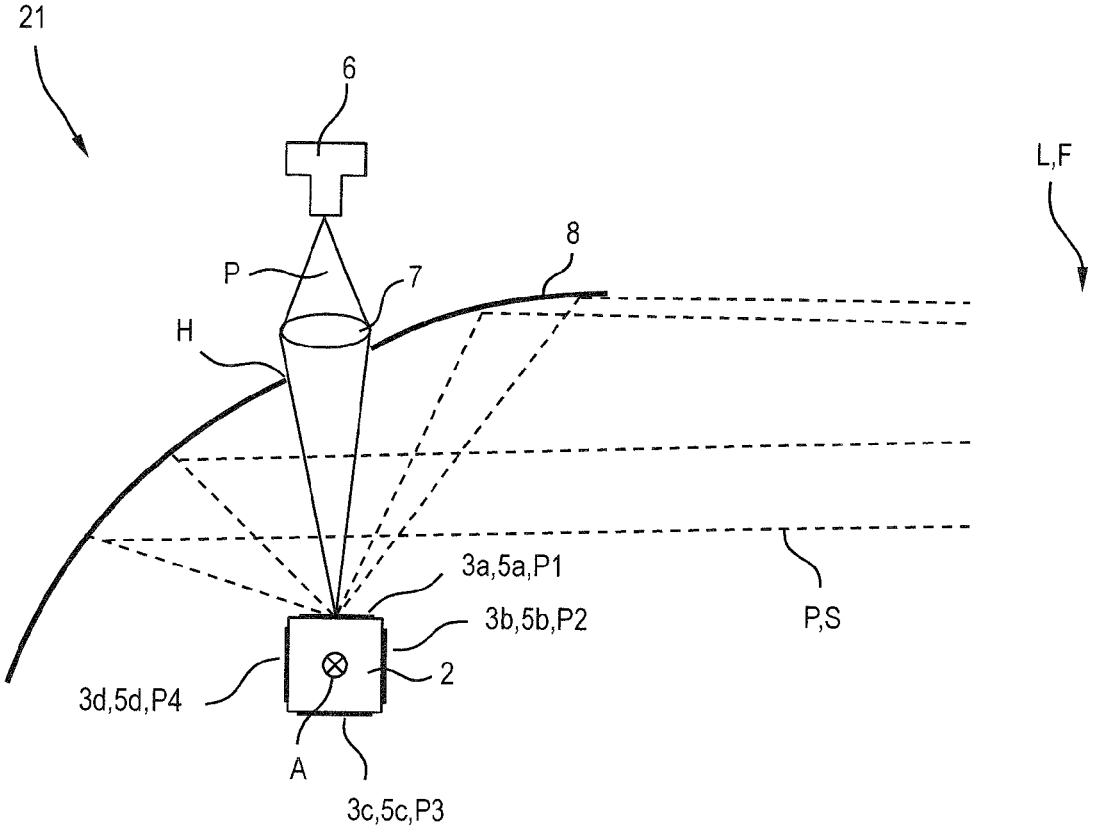

FIG. 3 shows a lighting device 21, e.g. for a vehicle headlight E, which is constructed in a manner similar to the lighting device 1, except that the primary light beam P is incident on the phosphor surfaces 3*a* to 3*d* perpendicularly, that is to say that its principal beam direction is parallel to the surface normal of the phosphor layer 5*a* to 5*d* or the prism face P1 to P4. Generally, the principal beam direction of the primary light P can be chosen freely in relation to the surface normal of the phosphor layer 5*a* to 5*d*.

Figure 4:
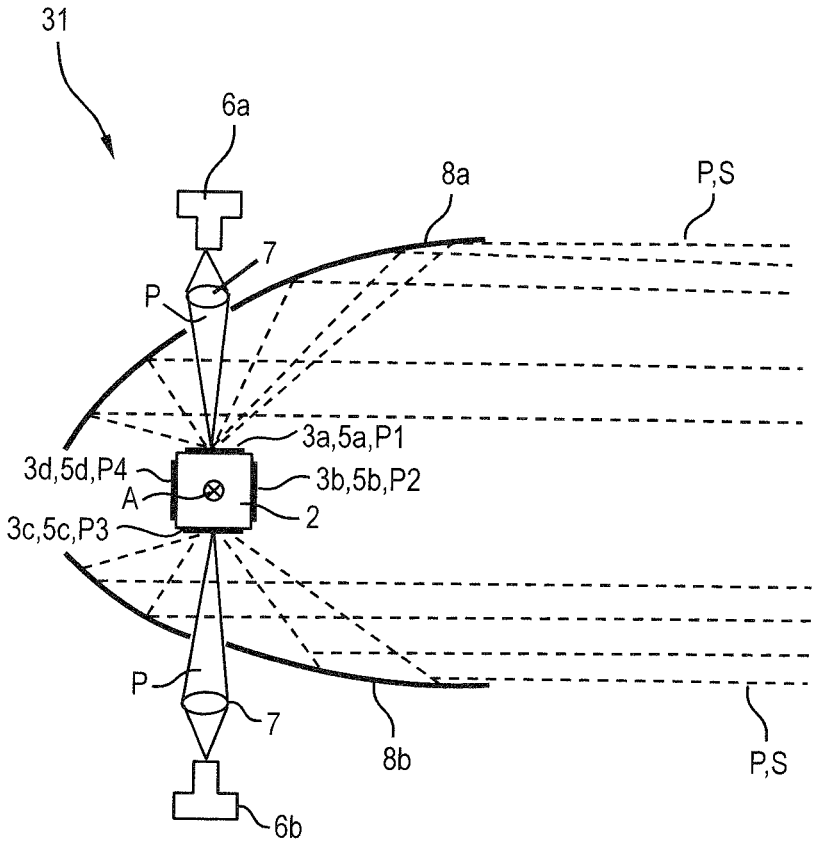

FIG. 4 shows a lighting device 31 e.g. for a vehicle headlight E, which is constructed in a manner similar to the lighting device 21, but where two reflectors 8*a* and 8*b* or corresponding reflection regions of one reflector 8*a*, 8*b* are present. Opposite phosphor surfaces 3*a*, 3*c* or 3*b*, 3*d* can then be irradiated simultaneously namely by different lasers 6*a* and 6*b*. The reflectors 8*a* and 8*b* in turn are illuminated by the phosphor surfaces 3*a*, 3*c* or 3*b*, 3*d*. A light emission pattern L in the far field can then be assembled by a superimposition of the mixed light P, S emitted by both reflectors 8*a* and 8*b*. This corresponds to an addition of the light generated by opposite phosphor surfaces 3*a*, 3*c* or 3*b*, 3*d*.

In this case, both lasers 6*a*, 6*b* need not be in operation for a specific light emission pattern. By way of example, a high beam may be generated by the operation of both lasers 6*a*, 6*b*, whereas the low beam may be generated e.g. by the operation of only one of the lasers 6*a* or 6*b*. Consequently, different light emission patterns can be made available by optional activation of the lasers 6*a* or 6*b* in a position of the carrier 2. It is possible to switch between two light emission patterns L by the rotation of the carrier 2 by 90°.

A light color of the light distributions emitted by the two reflectors 8*a*, 8*b* may be identical or different. Moreover, a light color of the primary light P emitted by the two lasers 6*a*, 6*b* may be identical or different.

Figure 5:
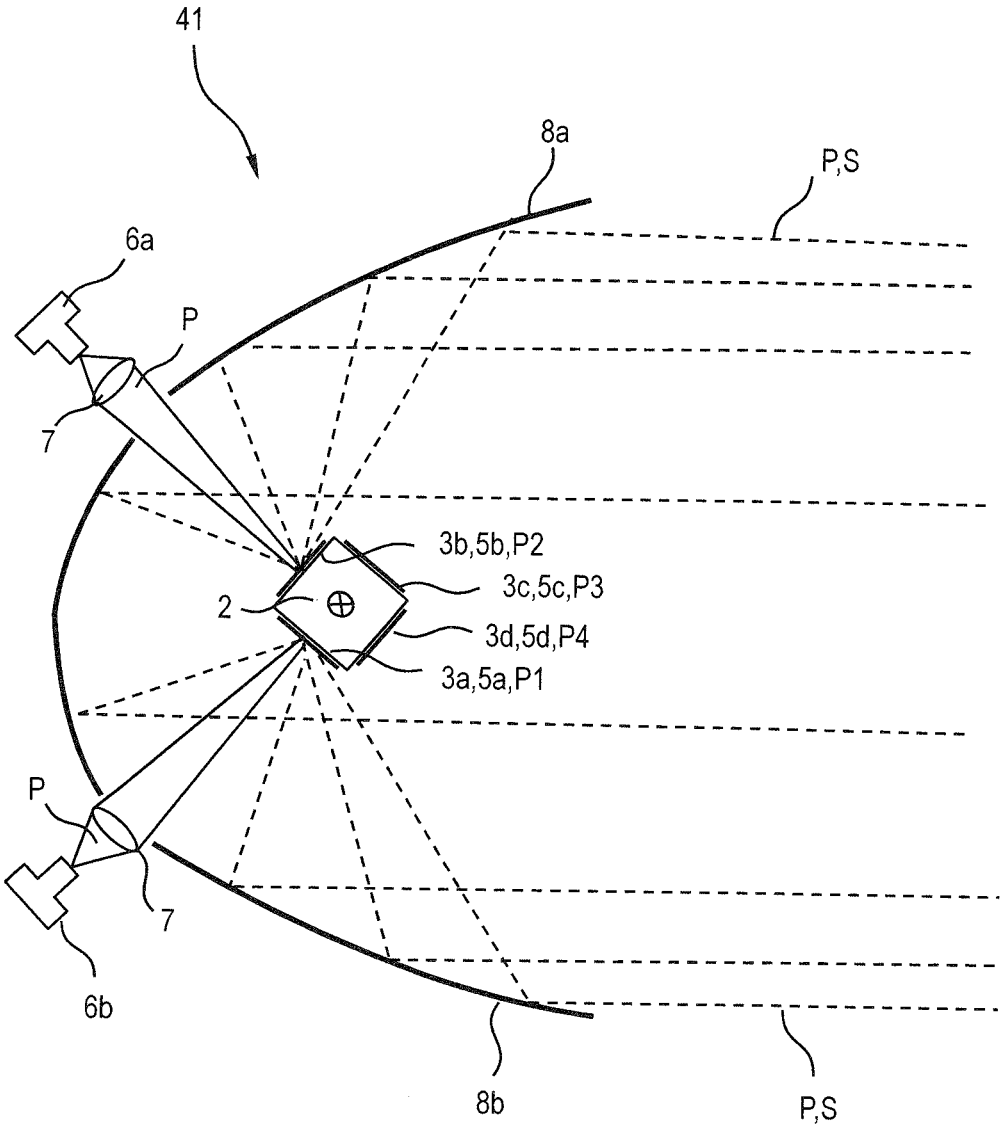

FIG. 5 shows a lighting device 41, e.g. for a vehicle headlight E, which is constructed in a manner similar to the lighting device 31, but now with phosphor surfaces 3*a* to 3*d* inclined in relation to the reflectors 8*a* and 8*b*, in order to achieve a greater optical efficiency depending on structural space relations and reflector design. As a result, two adjacent phosphor surfaces 3*a* and 3*b* or 3*c* and 3*d* can be illuminated simultaneously and generate in particular jointly light for generating a predetermined emission pattern. A change in a light emission pattern, e.g. a color change, can be achieved for example by a rotation of the carrier 2 and its rotation axis A by 180°.

Figure 6:
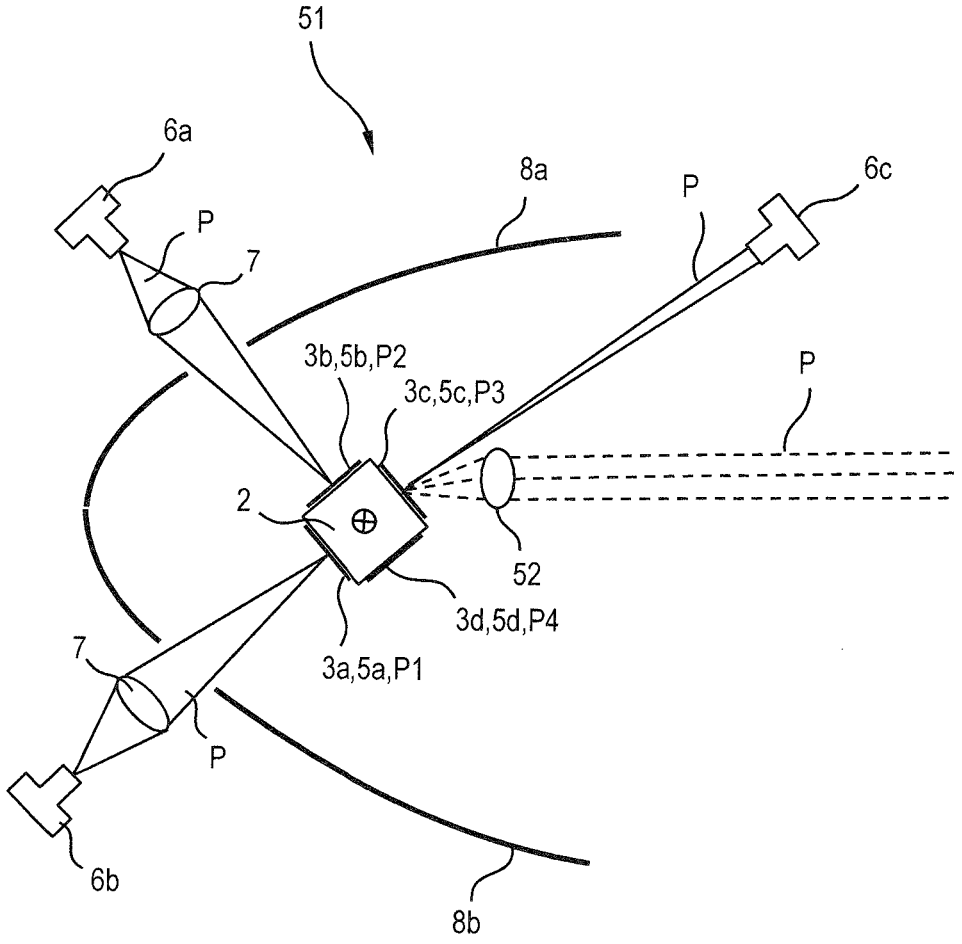

FIG. 6 shows a lighting device 51, e.g. for a vehicle headlight E, which is constructed in a manner similar to the lighting device 41, but additionally includes a laser 6*c* that irradiates the phosphor surface 3*c*. The light (in particular mixed light P, S) emitted by the phosphor surface 3*c* is not incident or is only partly incident on a reflector 8*a* or 8*b*. The light P, S not incident on the reflector 8*a* or 8*b* may be radiated into the far field F by means of an e.g. refractive optical unit 52. This light may be used e.g. for an auxiliary light distribution. The auxiliary light distribution may be independent or else provided as a support or as a supplementation for a light emission pattern generated by the two lasers 3*a* and/or 3*b*.

Figure 7:
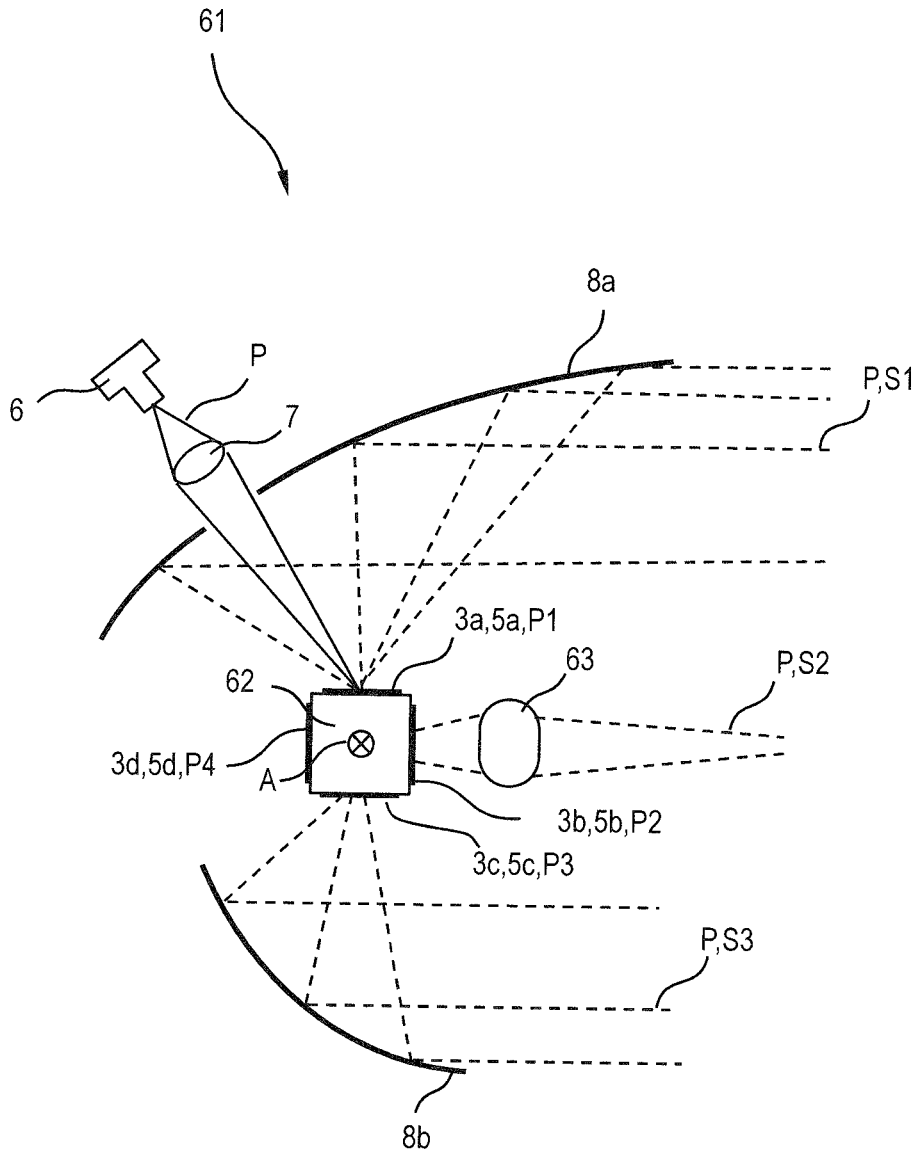

FIG. 7 shows a lighting device 61, e.g. for a vehicle headlight E, similar to the lighting device 1, wherein the reflector 8*b* is also present, but no laser 6*b*. In the case of the lighting device 61, the carrier 62 is light-transmissive, e.g. transparent.

The primary light P emitted by the laser 6 impinges on the phosphor layer 5*a* of the phosphor surface 3*a* and is partly converted thereby into a first secondary light S1 having a first wavelength. The first secondary light S1, if appropriate together with primary light P scattered in the phosphor layer 5*a*, is projected onto the reflector 8*a*. Non-converted and non-scattered primary light enters the carrier 62 through the prism face P1 and propagates there, e.g. by means of scattering and/or total internal reflection. At the prism faces P2 and P3, the primary light P emerges again from the carrier 62, namely with at least partial wavelength conversion into secondary light S2 and S3 at the phosphor layers 5*b* and 5*c*, respectively. From the phosphor layer 5*b* or the phosphor surface 3*b*, e.g. mixed light P, S2 is projected through a refractive optical unit 63 into the far field F. From the phosphor layer 5*c* or the phosphor surface 3*c*, e.g. mixed light P, S3 is projected onto the reflector 8*b* and deflected from there into the far field F. The light color of the mixed light beams P, S1, P, S2 and/or P, S3 may be identical or different. Moreover, the light color or wavelength of the secondary light S1, S2 and/or S3 may be identical or different. This can be achieved for example by identical or different phosphors in the phosphor layers 5*a*, 5*b* and/or 5*c*. At the fourth prism face P4, however, the primary light P cannot emerge from the carrier 62, e.g. on account of a covering with a layer that is reflective on both sides between the prism face P4 and the phosphor layer 5*d*.

In the position or rotational position shown, the light emission pattern L is achieved by means of a superimposition of the mixed light beams P, S1, P, S2 and P, S3.

A further light emission pattern can be generated by the carrier 62 being rotated by 90° in the clockwise direction, such that the phosphor layer 5*d* is illuminated. Since the latter, on account of the reflective layer, does not allow light to enter the carrier 62, it has an action like that in the case of the lighting device 1 and emits mixed light only onto the reflector 8*a*.

Figure 8:
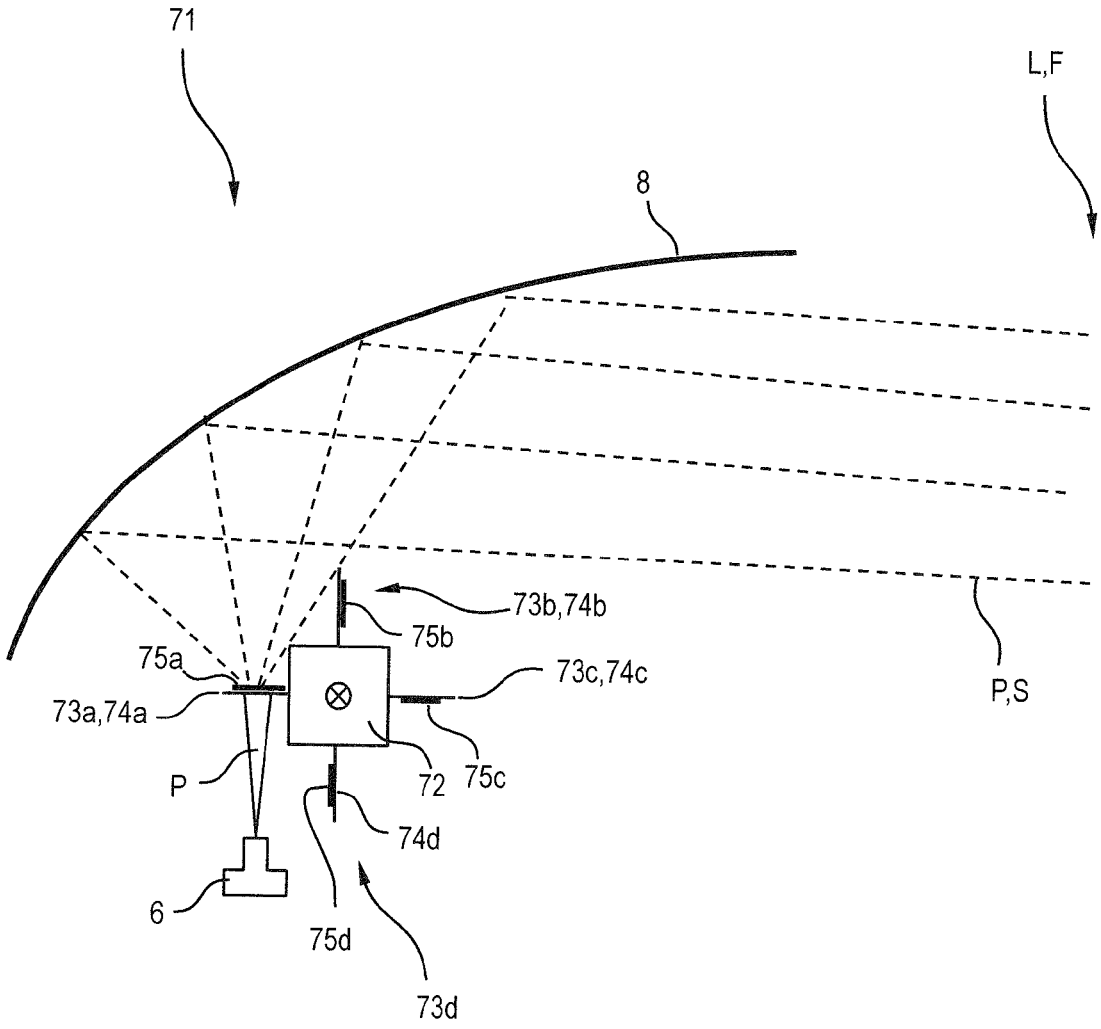

FIG. 8 shows a lighting device 71, e.g. for a vehicle headlight E, which is functionally similar to the lighting device 1. However, the at least partial wavelength conversion of the primary light P emitted by the laser 6 is now achieved by the use of a phosphor surface 73*a* to 73*d* operated with transmitted light.

For this purpose, each of the phosphor surfaces 73*a* to 73*d* has light-transmissive laminae 74*a* to 74*d* which protrude or are elevated perpendicularly from an associated prism face P1 to P4 of a carrier 72 and to which a respective phosphor layer 75*a* to 75*d* is applied. The laminae 74*a* to 74*d* may also serve for dissipating heat from the phosphor layer 75*a* to 75*d* to the carrier 72. The laminae 74*a* to 74*d* can be sapphire laminae, for example.

The primary light P emitted by the laser 6 impinges, in the position of the carrier 72 shown, on the phosphor layer 75*a* of the phosphor surface 73*a* and is partly converted there into e.g. yellow secondary light S. On that side of the phosphor layer 75*a* which faces away from the laser 6, non-converted and non-scattered-away blue primary light P and also yellow secondary light S emerge and are projected onto the reflector 8 as combined white mixed light P, S. In various embodiments, the primary side of the carrier 72 is covered with a dichroic layer which reflects the converted light S and thus increases the efficiency of the system. Analogously to the lighting device 1, different light emission patterns L can be generated by the rotation of the carrier 72 by 90° or a multiple thereof.

Figure 9:
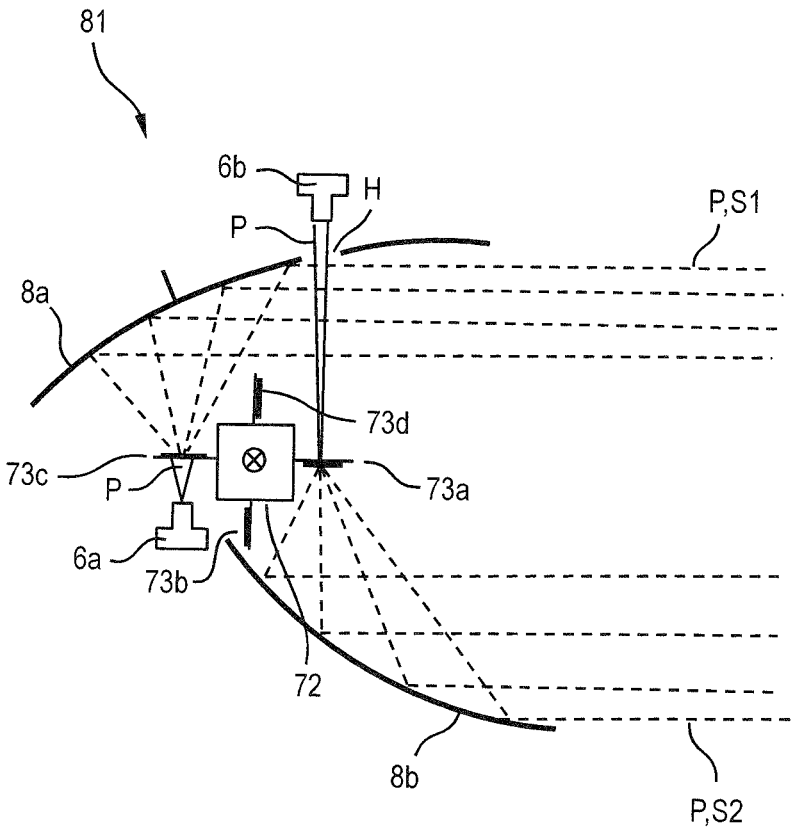

FIG. 9 shows a lighting device 81, e.g. for a vehicle headlight E, which is embodied in a manner functionally similar to the lighting device 31 in a transmitted-light arrangement similar to the lighting device 71. Here in a fixed position of the carrier 72 two phosphor surfaces 73*a* and 73*c* or 73*b* and 73*d* arranged on prism faces of the carrier 72 facing away from one another are illuminatable, namely also simultaneously. In the case of simultaneous illumination by the lasers 6*a* and 6*b*, the mixed light P, S1 and P, S2 emitted as useful light by the phosphor surfaces 73*c* and 73*a* is directed onto the reflectors 8*a* and 8*b*, respectively, from where it is deflected into the far field F for generating the light emission pattern L associated with the chosen position of the carrier 72.

Figure 10:
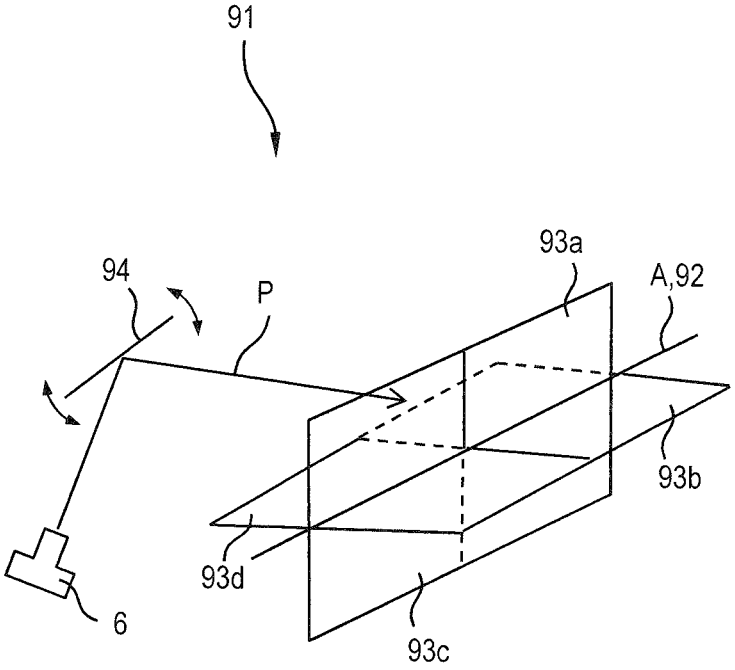
FIGS. 10 to 11 show in oblique view vehicle headlights with rotatable carriers in accordance with a tenth and eleventh embodiment.

FIG. 10 shows a lighting device 91, e.g. for a vehicle headlight E, which is constructed in a manner similar to the lighting device 71 with a carrier 92 which is rotatable about the rotation axis A and from which protrude phosphor surfaces 93*a* to 93*d* perpendicularly and in a manner angularly offset by 90°. Instead of the situation where, as in the case of lighting devices in FIG. 1 to FIG. 9, the phosphor surfaces are irradiated with the primary light P over a large area at a point in time (in a stationary fashion) and the phosphor surfaces are used as a quasi light source for an optical unit disposed downstream, the phosphor surfaces 93*a* to 93*d* now are swept over by a concentrated primary light beam P in a time-dependent manner ("dynamically") in each case depending on the position of the carrier 92. This makes it possible to generate a detailed illumination pattern on the currently illuminated phosphor surface 93*a*. In various embodiments, a pixel-like construction of the illumination pattern is thus made possible. The at least partly wavelength-converted mixed light emitted by the illumination pattern may be imaged into the far field F by an optical unit.

For the "scanning", e.g. line-like illumination of the phosphor surface 93*a*, the primary light P may be deflectable onto the phosphor surface 93*a* e.g. via at least one movable, e.g. pivotable, mirror 94, e.g. in a manner similar to a "flying spot" method. The pivotable mirror 94 may be e.g. an MEMS component. The laser 6 may be switchable on and off (or dimmable) in a targeted manner. The light emission pattern thus generated may be varied by a change in the illumination pattern given a fixed position or rotational position of the carrier 92.

Instead of four phosphor surfaces 93*a* to 93*d*, it is also possible to use a different number of phosphor surfaces, namely at least two phosphor surfaces, that is to say two, three, four, etc. phosphor surfaces.

Figure 11:
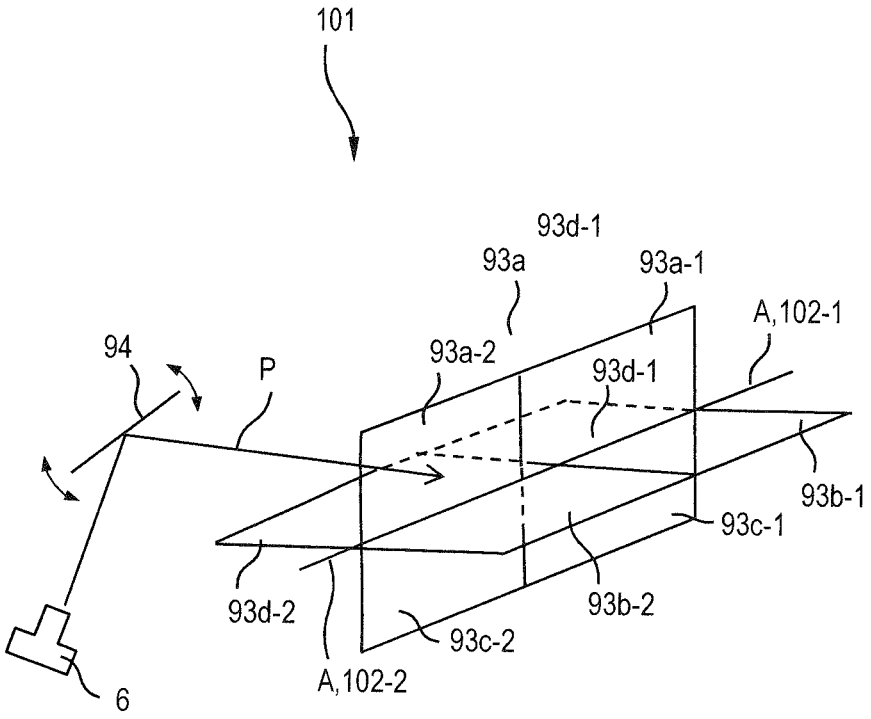

FIG. 11 shows a lighting device 101, e.g. for a headlight E, namely similar to the lighting device 91, but now with two carriers 102-1 and 102-2 having a basic construction similar in each case to the carrier 92. The carriers 102-1 and 102-2 have the same rotation axis A and are arranged directly adjacent to one another (i.e. here: separated only by a narrow gap negligible in practice). In order to generate a specific light emission pattern, the primary light beam P can sweep over two adjacent phosphor surfaces 93*a*-1 and 93*a*-2, 93*b*-1 and 93*b*-2, 93*c*-1 and 93*c*-2 or 93*d*-1 and 93*d*-2 situated in the same position. Since the carriers 102-1 and 102-2 are rotatable independently of one another, all possible adjacent phosphor surfaces 93*a*-1 to 93*d*-1, on the one hand, and 93*a*-2 to 93*d*-2, on the other hand, can be combined and generate a common light emission pattern.

Here, too, instead of four phosphor surfaces 93*a*-1 to 93*d*-1 and 93*a*-2 to 93*d*-2, it is possible to use a different number of phosphor surfaces, namely at least two phosphor surfaces, that is to say two, three, four, etc. phosphor surfaces.

In principle, the number of independently movable carriers is not restricted and may also include hundreds or even thousands of independently movable carriers. In this regard, e.g. an illumination field constructed in a matrix-like manner by the carriers can be generated. In this case, an individual carrier may correspond, in particular, to a pixel.

A matrix-like arrangement may e.g. also be realized by means of a micromirror system (DMD; "Digital Mirror Device"). In this case, each small micromirror of the DMD can be provided with one conversion colorant on one side and with another conversion colorant on the rear side, for example. By the switching of the micromirror, these can be rotated by 180° and a change of the conversion colorant in the beam path of the primary light can thus be achieved.

Instead of the dynamic illumination, static illumination may also be used, e.g. by a primary light beam P guided in a stationary fashion.

Figure 12:
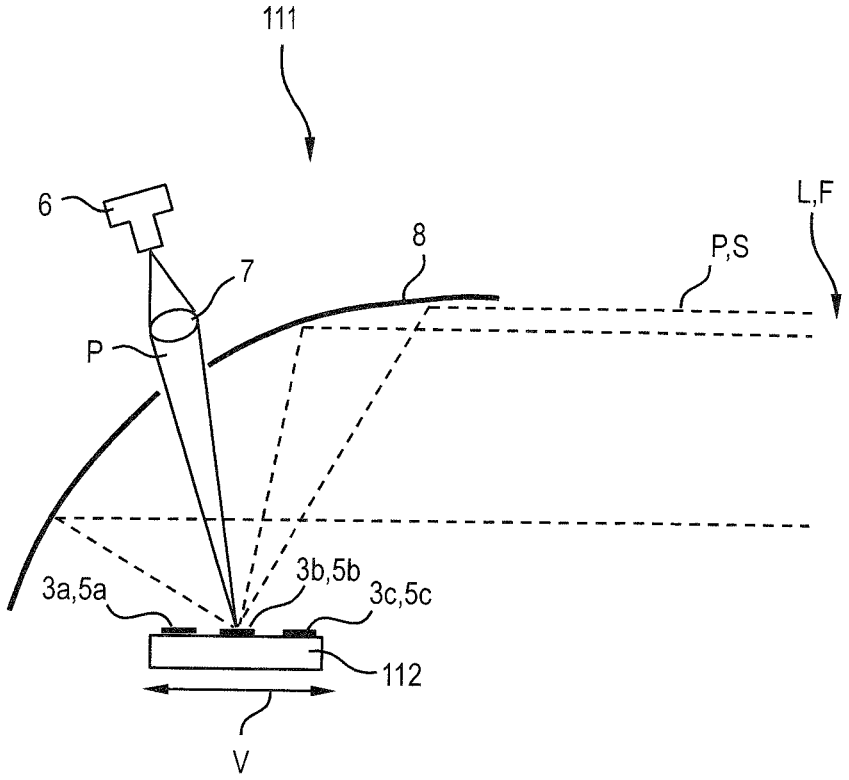
FIG. 12 shows as a sectional illustration in side view a vehicle headlight with a non-rotatable carrier.

FIG. 12 shows a lighting device 111, e.g. for a vehicle headlight E, in the case of which the phosphor surfaces 3*a*, 3*b* and 3*c* now bear alongside one another in a row on a planar surface of a plate- or sheet-like carrier 112. In order to generate a specific light emission pattern L in the far field F, the carrier 112 can be displaced along its extensive plane by means of a linear movement, here along the displacement direction V. In this case, the carrier 112 occupies different positions in which respective phosphor surfaces 3*a*, 3*b* and 3*c* or phosphor layers 5*a*, 5*b* and 5*c* are irradiatable for generating an individually associated light emission pattern L by means of the primary light beam P generated by the laser 6. For effective dissipation of heat from the phosphor surfaces 3*a*, 3*b* and 3*c*, the carrier 112 preferably consists of metal or a sapphire-on-metal layer stack. The carrier 112 can be moved e.g. by piezoactuators and/or (stepper) motors.

It is also possible to distribute the phosphor surfaces 3*a*, 3*b* and 3*c* on the carrier 112 in a two-dimensionally laterally extended manner, e.g. in a matrix-shaped fashion, in a cross-shaped fashion, etc. (also see FIG. 14). By a movement of the carrier 112 in both lateral or planar directions (in the direction V and a direction perpendicular thereto in the plane of the drawing), all the different phosphor surfaces 3*a*, 3*b* and 3*c* can be impinged on. A two-dimensional arrangement makes it possible to compactly accommodate more phosphor surfaces than in the case of an only one-dimensional (strip-shaped) arrangement.

Figure 13:
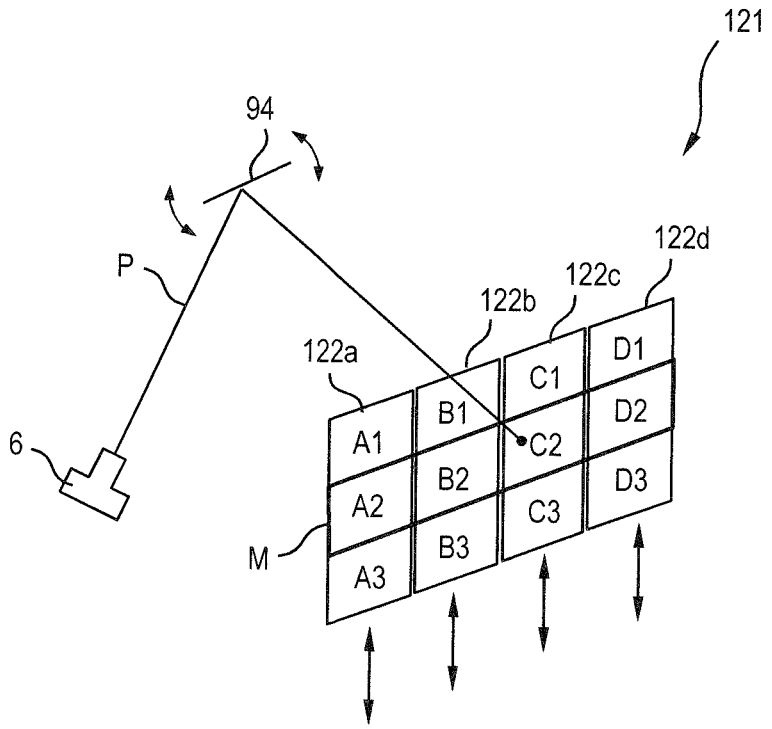
FIG. 13 shows in oblique view a further vehicle headlight with a non-rotatable carrier.

FIG. 13 shows a lighting device 121, e.g. for a vehicle headlight E, in the case of which there are now a plurality of strip-like carriers 122*a*, 122*b*, 122*c* and 122*d* (here for example four thereof aligned perpendicularly) having in each case phosphor surfaces A1 to A3, B1 to B3, C1 to C3 and D1 to D3, respectively arranged alongside one another in a series. The carriers 122*a*, 122*b*, 122*c* and 122*d* are displaceable parallel to one another along their longitudinal axes, as indicated by the double-headed arrows. The illumination area F which is illuminatable in a scanning fashion by the laser 6 via a pivotable mirror 94 includes a line of phosphor surfaces A1 to A3, B1 to B3, C1 to C3 or D1 to D3, respectively, arranged alongside one another transversely with respect to the displacement direction thereof, e.g. a line including the phosphor surfaces A2, B2, C2 and D2. In other words, in each case one phosphor surface of a strip-shaped carrier 122*a* to 122*d* can be illuminated simultaneously. The phosphor surfaces A1 to A3, B1 to B3, C1 to C3 and D1 to D3, respectively, of a strip-shaped carrier 122*a* to 122*d* can have, in particular, a different phosphor composition (e.g. with regard to a type, quantity and/or areal distribution of phosphor) and, as a result, can generate a differently shaped and/or differently colored part of the entire light emission pattern.

A specific light emission pattern can be established for example by arbitrary, but then fixedly chosen combination of the phosphor surfaces A1 to A3, B1 to B3, C1 to C3 and D1 to D3, respectively. The light generated in this case can again be projected into the far field F through an optical unit (not illustrated), in particular an imaging optical unit.

Alternatively, besides a scanning or localized, in particular pixel-like, illumination, it is also possible to carry out a stationary illumination of the phosphor surfaces A1 to A3, B1 to B3, C1 to C3 and D1 to D3, respectively.

Figure 14:
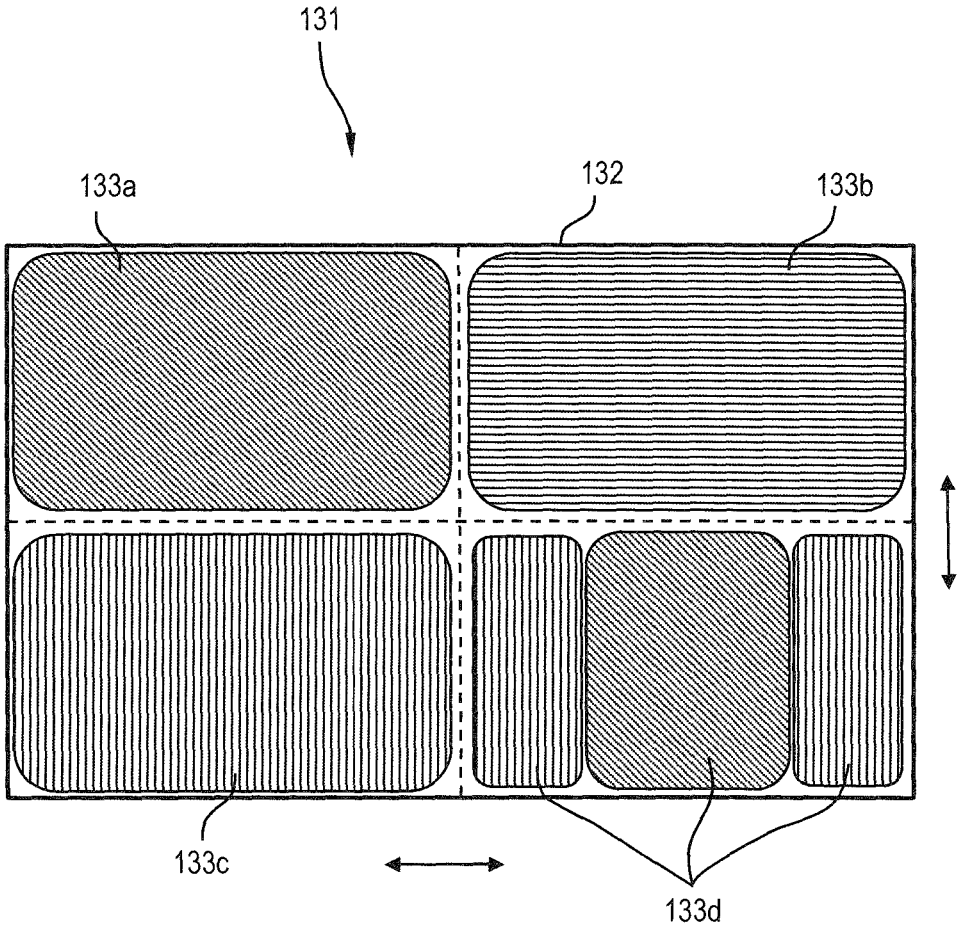
FIG. 14 shows in plan view a non-rotatable carrier with a plurality of phosphor surfaces.

FIG. 14 shows in a frontal view a carrier 132 of a lighting device 131 with four phosphor surfaces 133*a*, 133*b*, 133*c* and 133*d* arranged alongside one another in a 2×2 matrix pattern. The carrier 132 may be a sapphire lamina, for example. In each case only one phosphor surface 133*a*, 133*b*, 133*c* or 133*d* is illuminated (in a stationary or scanning fashion).

Each individual phosphor surface 133*a*, 133*b*, 133*c* or 133*d* can generate a complete light emission pattern. By a movement of the carrier 132 in the plane of the carrier 132, the latter can be moved such that each of the phosphor surfaces 133*a*, 133*b*, 133*c* or 133*d* can be brought into the beam path of the primary light. The movement is indicated by the double-headed arrows.

The individual phosphor surfaces 133*a*, 133*b*, 133*c* or 133*d* contain different distributions of phosphors.

By way of example, the phosphor surface 133*a* may be covered homogeneously with a blue-yellow converting phosphor having a first layer thickness, in order to generate and emit cold-white light. The phosphor surface 133*b* may be covered homogeneously with a blue-yellow converting phosphor having a second layer thickness, which is thicker than the first layer thickness. Yellowish-white light can be generated and emitted as a result. A warmer hue can also be achieved by the addition of a blue-red converting phosphor. The phosphor surface 133*c* may be covered homogeneously with a blue-yellow converting phosphor having a third layer thickness, which is less than the first layer thickness. Bluish-white light can be generated and emitted as a result. The phosphor surface 133*d* may have a plurality of partial regions covered in each case homogeneously with a blue-yellow converting phosphor. In this regard, two outer regions may be covered in a manner similar to the phosphor surface 133*c* and a central region may be covered in a manner similar to the phosphor surface 133*a*.

However, a (2×2) pattern of the individual phosphor surfaces need not necessarily be used. In this regard, any other arbitrary division into an (n×m) pattern is possible, wherein n and m are integers, at least one of which is greater than one. In addition, a length-to-width ratio or aspect ratio of the individual phosphor surfaces can be chosen freely. The individual phosphor surfaces need not be rectangular, but rather can also assume other shapes. Regions that are free of phosphor can also be present between the phosphor surfaces. Moreover, an irregular arrangement of the phosphor surfaces is possible. Likewise, the arrangement of the phosphor within a phosphor surface is not limited. Any desired division can be used. Realizations are possible both in a transmissive use (transmitted-light arrangement as shown) and in a reflective use of the phosphor.

Figure 15:
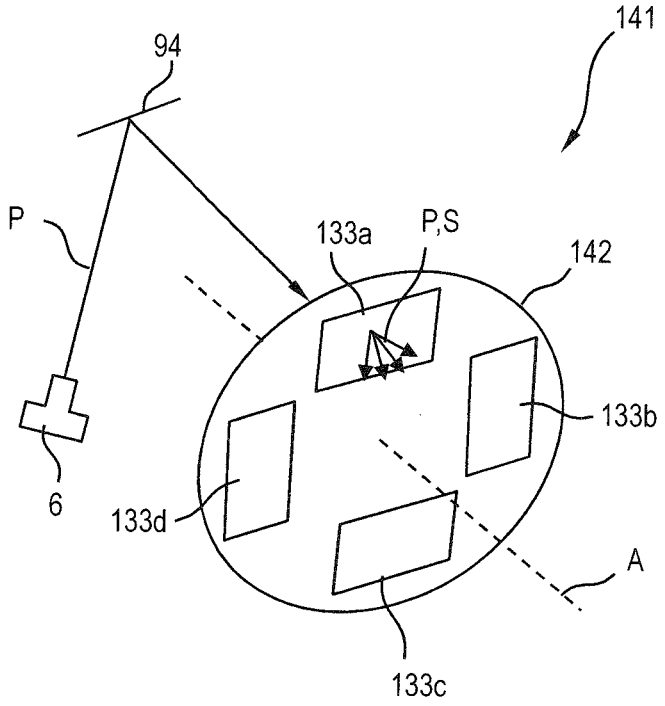
FIG. 15 shows in oblique view a vehicle headlight with a rotatable carrier in accordance with a twelfth embodiment.

FIG. 15 shows in an oblique view a lighting device 141, e.g. for a vehicle headlight E, in the case of which now a flat carrier 142 e.g. in the form of a sapphire lamina, rotatable about its axis A of symmetry is covered with four phosphor surfaces 133*a*, 133*b*, 133*c* or 133*d*. By a rotation by here 90°, in each case one of the phosphor surfaces 133*a*, 133*b*, 133*c* or 133*d* can be irradiated by the primary light P.

Figure 16:
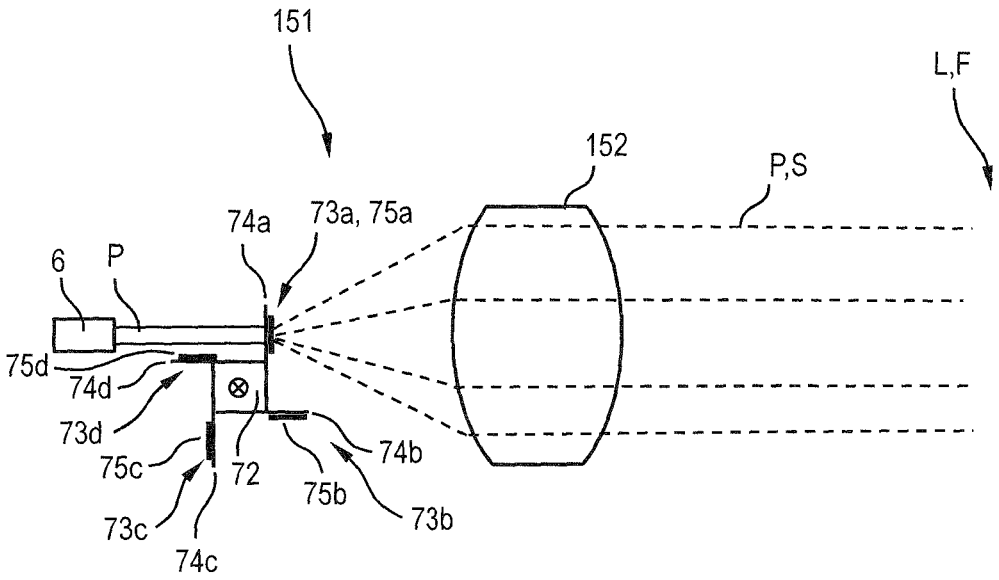
FIG. 16 shows as a sectional illustration in side view a vehicle headlight with rotatable carriers in accordance with a thirteenth embodiment.

FIG. 16 shows, as a sectional illustration in side view, a lighting device 151, e.g. for a vehicle headlight E, in the case of which the primary light P incident from the laser 6 is partly converted into secondary light S by means of a phosphor surface 73*a* with a phosphor layer 75*a* in a manner similar to FIG. 8 in a transmitted-light arrangement. The light S emitted by the phosphor surface 73*a* is now radiated into the far field F as light emission pattern L exclusively through a refractive optical unit 152.

The optical unit 152 can be traditionally imaging or may be imaging e.g. only in one angular direction. It may have, by way of example, a multifaceted freeform. A flanking reflector (not illustrated) can support the refractive optical unit 152.

Although the invention has been described and illustrated more specifically in detail by means of the embodiments shown, nevertheless the invention is not restricted thereto and other variations can be derived therefrom by the person skilled in the art, without departing from the scope of protection of the invention.

In this regard, a choice may be made, in principle, between stationary and scanning irradiation of a phosphor surface.

Generally, "a (an)", "one", etc. can be understood to mean a singular or a plural, in particular in the sense of "at least one" or "one or a plurality", etc., as long as this is not explicitly excluded, e.g. by the expression "exactly one", etc.

Moreover, a numerical indication can encompass exactly the indicated number and also a customary tolerance range, as long as this is not explicitly excluded.

REFERENCE SIGNS

1 Lighting device for a vehicle headlight
2 Carrier
3*a-d* Phosphor surface
3*e* Phosphor surface
3*f* Phosphor surface
4 Lateral surface
5*a-f* Phosphor layer
6 Laser
6*a-c* Laser
7 Lens
8 Reflector
8*a-b* Reflector
11 Vehicle headlight
12 Carrier
21 Lighting device for a vehicle headlight
31 Lighting device for a vehicle headlight
41 Lighting device for a vehicle headlight
51 Lighting device for a vehicle headlight
52 Refractive optical unit
61 Lighting device for a vehicle headlight
62 Carrier
63 Refractive optical unit
71 Lighting device for a vehicle headlight
72 Carrier
73*a-d* Phosphor surface
74*a-d* Light-transmissive lamina
75*a-d* Phosphor layer
81 Lighting device for a vehicle headlight
91 Lighting device for a vehicle headlight
92 Carrier
93*a-d* Phosphor surface
93*a*-1 Phosphor surface
93*a*-2 Phosphor surface
93*b*-1 Phosphor surface
93*b*-2 Phosphor surface
93*c*-1 Phosphor surface
93*c*-2 Phosphor surface
93*d*-1 Phosphor surface
93*d*-2 Phosphor surface
94 Mirror
101 Lighting device for a vehicle headlight
102-1 Carrier
102-2 Carrier
111 Lighting device for a vehicle headlight
112 Carrier
121 Lighting device for a vehicle headlight
122*a-d* Carrier
131 Lighting device for a vehicle headlight
132 Carrier
133*a-d* Phosphor surface
141 Lighting device for a vehicle headlight
142 Carrier
151 Lighting device for a vehicle headlight
152 Refractive optical unit
A Rotation axis
A1-A3 Phosphor surface
B1-B3 Phosphor surface
C1-C3 Phosphor surface
D1-D3 Phosphor surface
E Vehicle headlight
F Far field
H Hole
L Light emission pattern
M Illumination area
P Primary light
P1-P6 Prism face
S Secondary light
S1-S3 Secondary light While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A lighting device for a headlight for generating a light emission pattern in a far field, the lighting device comprising:

at least two phosphor surfaces arranged rotationally movably between different positions;

at least one light source spaced apart from the phosphor surfaces and serving for emitting primary light for illuminating a portion of the phosphor surfaces;

wherein an associated predetermined light emission pattern is generatable in respectively exactly one predetermined position of the phosphor surfaces; and wherein the headlight is a vehicle headlight.

2. The lighting device of claim 1;

wherein at least two different light emission patterns have a different shape.

3. The lighting device of claim 1, wherein at least two different light emission patterns have a different light color.

4. The lighting device of claim 1, wherein at least two different light emission patterns have a different color distribution.

5. The lighting device of claim 1, wherein at least two different light emission patterns have a differently white light color.

6. The lighting device of claim 1, wherein a light emission pattern is generatable by means of at least one primary light beam aligned in a stationary fashion.

7. The lighting device of claim 1, wherein a light emission pattern is generatable by a movement of at least one primary light beam.

8. The lighting device of claim 1, wherein the phosphor surfaces are arranged fixedly on a rotatable carrier.

9. The lighting device of claim 7, wherein the phosphor surfaces are rotatable in a plane.

10. The lighting device of claim 1, wherein the light emission pattern is generatable by a simultaneous illumination of a plurality of rotationally movable phosphor surfaces.

11. The lighting device of claim 10, wherein the light emission pattern is generatable by a simultaneous illumination of a plurality of individually movable phosphor surfaces.

12. The lighting device of claim 1, wherein the headlight is an Adaptive Frontlighting System headlight.

13. The lighting device of claim 1, wherein the headlight is an Adaptive Driving Beam headlight.

14. A lighting device for a headlight for generating a light emission pattern in a far field, the lighting device comprising:

at least two phosphor surfaces arranged rotationally movably between different positions;

at least one light source spaced apart from the phosphor surfaces and serving for emitting primary light for illuminating a portion of the phosphor surfaces;

wherein an associated predetermined light emission pattern is generatable in respectively exactly one predetermined position of the phosphor surfaces; and wherein at least two different light emission patterns have a different shape.

15. The lighting device of claim 14, wherein at least two different light emission patterns have a different color distribution.

16. The lighting device of claim 14, wherein at least two different light emission patterns have a differently white light color.

17. The lighting device of claim 14, wherein a light emission pattern is generatable by means of at least one primary light beam aligned in a stationary fashion.

18. The lighting device of claim 14, wherein a light emission pattern is generatable by a movement of at least one primary light beam.

19. A lighting device for a headlight for generating a light emission pattern in a far field, the lighting device comprising:

at least two phosphor surfaces arranged rotationally movably between different positions;

at least one light source spaced apart from the phosphor surfaces and serving for emitting primary light for illuminating a portion of the phosphor surfaces;

wherein an associated predetermined light emission pattern is generatable in respectively exactly one predetermined position of the phosphor surfaces; and wherein the light emission pattern is generatable by a simultaneous illumination of a plurality of rotationally movable phosphor surfaces.

20. The lighting device of claim 19, wherein the light emission pattern is generatable by a simultaneous illumination of a plurality of individually movable phosphor surfaces.

* * * * *